US006729349B2

(12) United States Patent
Brandebusemeyer

(10) Patent No.: US 6,729,349 B2
(45) Date of Patent: May 4, 2004

(54) DECK-MOUNT FAUCET

(75) Inventor: Heinz Brandebusemeyer, Menden (DE)

(73) Assignee: Friedrich Grohe AG & Co. KG, Hemer (DE)

( * ) Notice: Subject to any disclaimer, the term of this patent is extended or adjusted under 35 U.S.C. 154(b) by 44 days.

(21) Appl. No.: 10/234,606

(22) Filed: Sep. 4, 2002

(65) Prior Publication Data

US 2003/0051758 A1 Mar. 20, 2003

(30) Foreign Application Priority Data

Sep. 19, 2001 (DE) ..... 101 46 277

(51) Int. Cl.[7] ..... E03C 1/04
(52) U.S. Cl. ..... 137/615; 137/801
(58) Field of Search ..... 137/615, 801

(56) References Cited

U.S. PATENT DOCUMENTS 5,301,715 A * 4/1994 Becker ..... 137/615
5,848,614 A * 12/1998 Becker ..... 137/801
5,873,387 A * 2/1999 Weber et al. ..... 137/615
6,070,611 A * 6/2000 Becker ..... 137/625.4
6,070,614 A * 6/2000 Holzheimer et al. ..... 137/801
6,435,212 B2 * 8/2002 Brandebusemeyer ..... 137/615

FOREIGN PATENT DOCUMENTS

DE 41 13 879 9/1996

* cited by examiner

*Primary Examiner*—Gerald A. Michalsky
(74) *Attorney, Agent, or Firm*—Herbert Dubno; Andrew Wilford

(57) ABSTRACT

A faucet has according to the invention a support body centered on an upright axis and adapted to be fixed to a horizontal support surface. The body is formed with a radially outwardly open outer groove having upper and lower axially spaced and confronting flanks and a radially outwardly directed floor. A sleeve fitted over and surrounding the body has a radially inwardly directed inner surface level with the outer groove and an axially downwardly directed shoulder generally level with the upper flank. A hard split bearing ring set in the outer groove has an outer face bearing on the inner sleeve surface, an upper face on which the shoulder rests, a lower face bearing on the lower flank, and an inner face radially confronting the floor. A biasing element braced radially between the bearing ring and the body presses the outer surface of the bearing ring against the inner surface of the sleeve.

12 Claims, 2 Drawing Sheets

DECK-MOUNT FAUCET

FIELD OF THE INVENTION

The present invention relates to plumbing fixture. More particularly this invention concerns a deck-mount faucet.

BACKGROUND OF THE INVENTION

As described in German patent 4,113,879 of M. Pawelzik published Nov. 14, 1991, a deck-mount faucet has a support body centered on an upright axis, adapted to be fixed to a horizontal support surface, and carrying a valve cartridge connected through the body with hot- and cold-water supplies and to an output passage opening radially on the passage. A sleeve fitted over and surrounding the body carries a radially projecting spout that communicates with the output passage so that the sleeve can swivel about the axis while mixed water is fed from the supplies to the spout.

A ring is provided between the body and the sleeve to support the sleeve on the body while permitting the sleeve and spout to swivel on the body. The problem with this system is that, as the fixture ages and is used the ring wear and the fit between the sleeve and the body becomes looser, making the faucet so free that it can wander from its position by itself when in use.

OBJECTS OF THE INVENTION

It is therefore an object of the present invention to provide an improved deck-mount faucet.

Another object is the provision of such an improved deck-mount faucet which overcomes the above-given disadvantages, that is which can be sure to swivel properly even over a long service life.

SUMMARY OF THE INVENTION

A faucet has according to the invention a support body centered on an upright axis and adapted to be fixed to a horizontal support surface. The body is formed with a radially outwardly open outer groove having upper and lower axially spaced and confronting flanks and a radially outwardly directed floor. A sleeve fitted over and surrounding the body has a radially inwardly directed inner surface level with the outer groove and an axially downwardly directed shoulder generally level with the upper flank. A hard split bearing ring set in the outer groove has an outer face bearing on the inner sleeve surface, an upper face on which the shoulder rests, a lower face bearing on the lower flank, and an inner face radially confronting the floor. In accordance with the invention a biasing element braced radially between the bearing ring and the body presses the outer surface of the bearing ring against the inner surface of the sleeve. The biasing element according to the invention is an unsplit elastomeric biasing ring bearing radially inward on the body and radially outward on the bearing ring.

Thus with this system the bearing ring can be made of a durable wear-resistant material, e.g. a polyamide, while the biasing ring can be of a softer material. Separating the functions ensures that the wear will be restricted to the outer bearing ring since there is no significant slippage or movement between the two rings or between the bearing ring and the support body.

The body is formed in the outer-groove floor with a radially outwardly open inner groove holding the biasing ring and of an axial dimension equal to about half that of the outer groove holding the bearing ring. Thus the floor of the outer groove is actually two axially spaced cylindrical lands flanking the inner groove.

The bearing ring has a radial dimension greater than a radial depth of the outer groove so that the bearing ring projects radially past the groove floor and holds the inner ring face off the groove floor. In fact the biasing element holds the bearing ring at least 0.2 mm radially outward from the groove floor.

The bearing-ring end faces according to the invention are parallel and perpendicular to the bearing-ring inner face. In addition the bearing-ring outer face is outwardly convex so that it engages the sleeve inner face in what is effectively line contact.

The bearing ring has in accordance with the invention a width measured parallel to the axis and a thickness measured perpendicular to the axis. The width is about three times the thickness. Furthermore the inner surface of the sleeve is substantially cylindrical and centered on the axis and the sleeve has an outwardly chamfered lower end edge. Thus the sleeve can be forced down over the support body after the bearing and biasing rings are mounted on it to compress the biasing ring inward.

A valve cartridge carried on the body is connectable through the body with hot- and cold-water supplies. The sleeve surrounds the cartridge and is formed with a spout carrying spray head fitted in but removable from the spout. A hose connected to the valve cartridge extends to the spray head. This hose extends from the cartridge down through the body and then back up through the body to the spray head.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
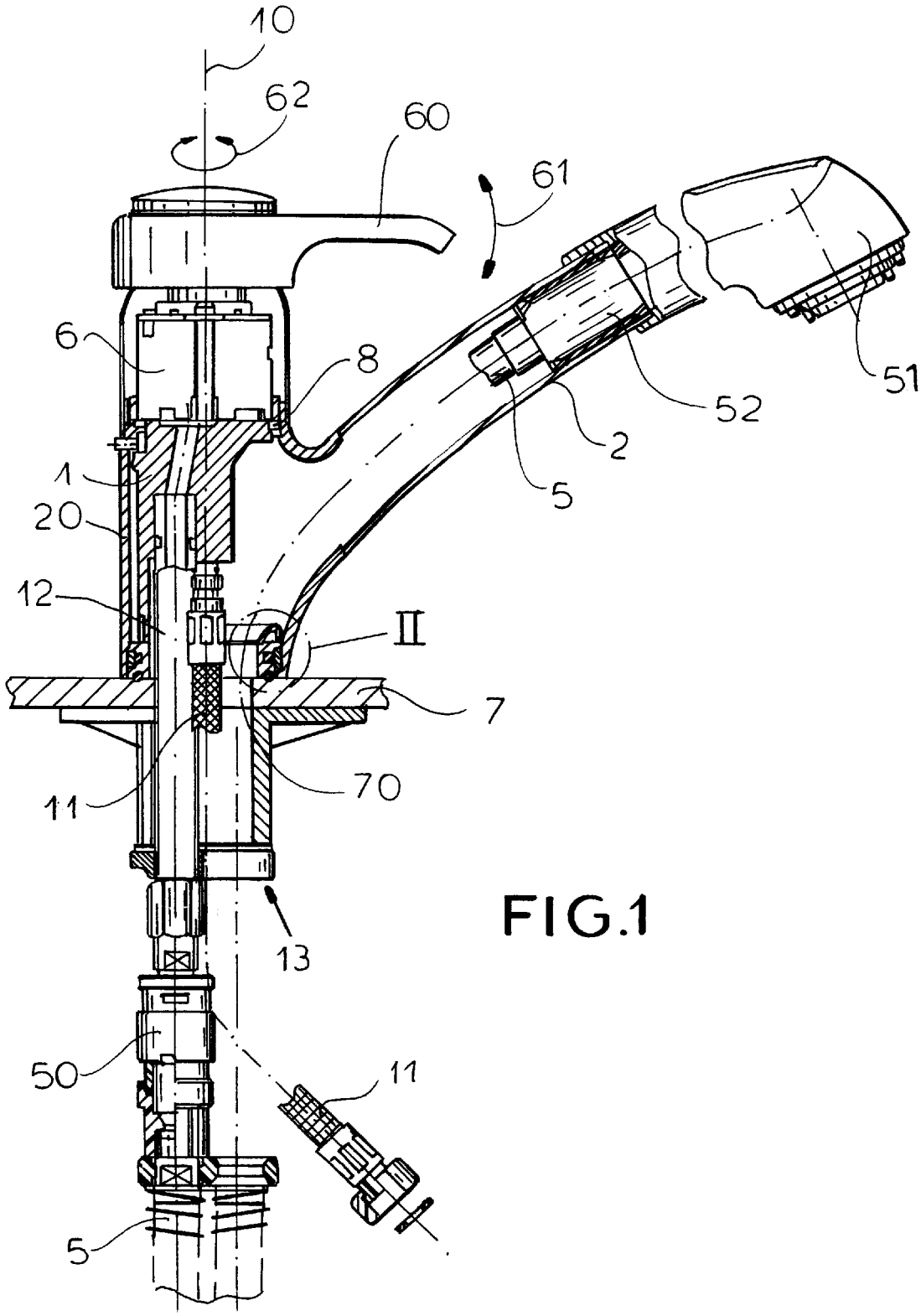
FIG. 1 is a vertical section through the faucet according to the invention.

As seen in FIG. 1 a faucet in accordance with the invention has a cast-metal body 1 secured by a nut assembly 13 to an upper surface of a counter 7 over a hole 70 therein and centered on a vertical axis 10. A spout 2 extends upward at an angle from a sleeve 20 that fits over the body 1 and that can pivot thereon about the axis 10.

The body 1 carries a cartridge valve 6 that is connected to hot-and cold-water inlet lines 11 (only one shown) and to a mixed-water output pipe 12 that extends down through the hole 70 where it is connected underneath the counter 7 at a fitting 50 to a hose 5 that extends back up through the hole and connects to a sprayer head 51 having a stem 52 seated in the spout 2. Thus the spray head 51 can be pulled out of the spout 2 for use as a hand sprayer, or it can be left in the illustrated position for use as a normal swing faucet.

The valve 6 is operated by a handle 60 that can be turned about the axis 10 as indicated by arrow 62 to vary the temperature of the water fed to the output pipe 12 and that can be tipped about a horizontal axis as shown by arrow 61 to vary the volume of flow to the pipe 12. This is all generally standard.

Figure 2:
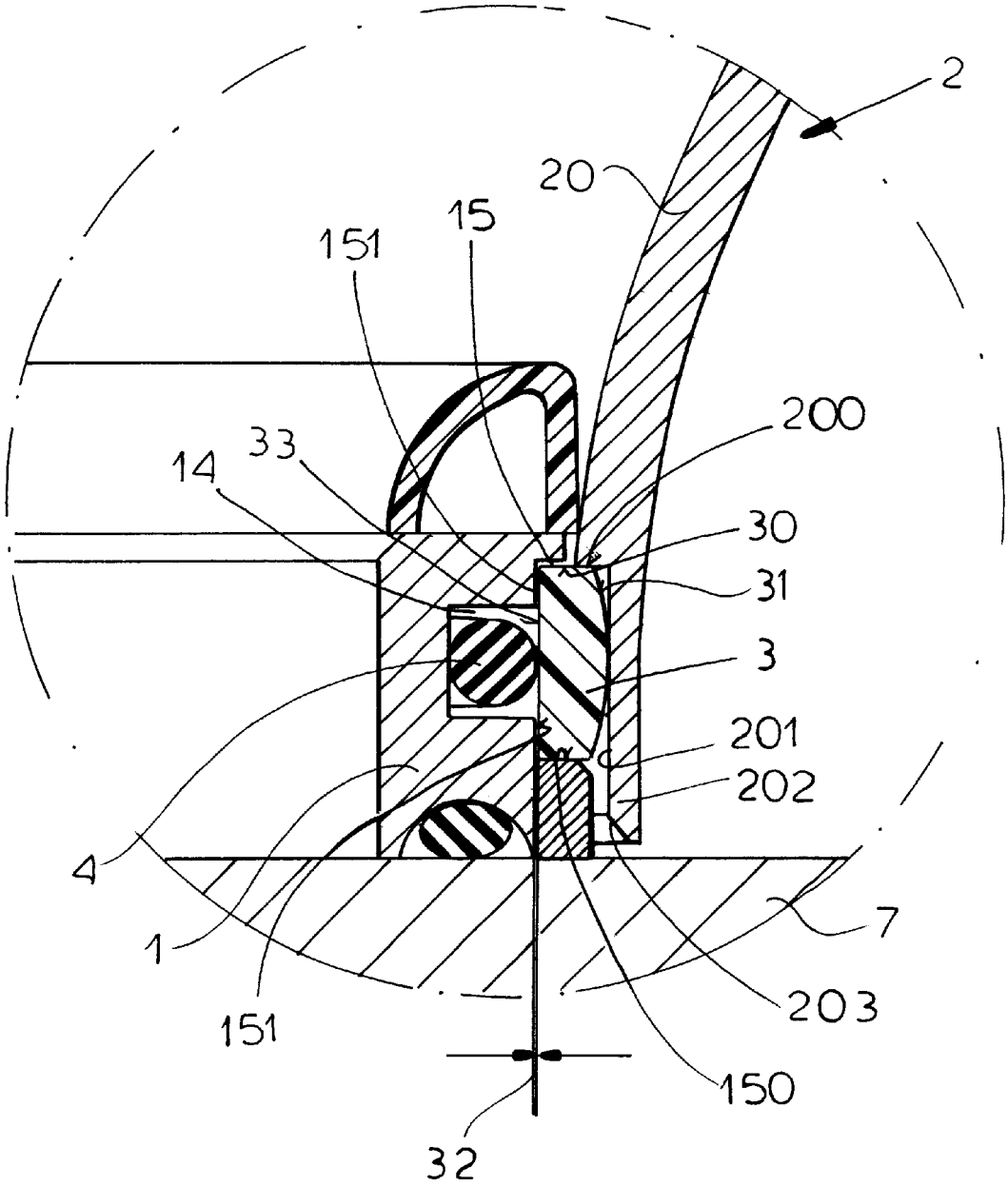
FIG. 2 is a large-scale view of the detail indicated at II in FIG. 1.

According to the invention as shown in FIG. 2 the body 1 is formed with a radially outwardly open groove 15 having a radially outwardly directed cylindrical floor 151 and a pair of parallel, planar, and annular end flanks 150 flanking the floor 151. A split hard-plastic ring 3 is set in this groove 15 and has a pair of axially oppositely directed, planar, and annular faces 30 confronting the flanks 150, a cylindrical inner face 33 radially confronting and spaced outward by a distance 32 of 0.2 mm from the floor 151, and an outwardly convex and smoothly curved outer face 31.

The lower end of the sleeve 20 has an outwardly offset cylindrical inner surface 201 bearing on the ring outer face 31 in line contact and a downwardly directed, annular, and planar shoulder 200 that sits on the upper face 30 of the bearing ring 3, forcing the lower face 30 down against the lower flank 150 of the groove 15. The sleeve 20 extends downward with a skirt 202 past the ring 3 and has a chamfered lower edge 203 that facilitates assembly of the structure. The lower end of the sleeve 20 is closely but spacedly juxtaposed with the upper surface of the counter 2 so that it completely hides the ring 3 and the body 1 and these parts are therefore not visible.

A square-section groove 14 of an axial dimension substantially shorter than the groove 15 is formed in the center of the groove floor 151 and holds a circular-section elastomeric biasing ring 4 that presses the bearing ring 3 outward, thereby setting the space 32 and pressing the face 31 against the surface 201. The biasing ring 4 therefore ensures that the ring 3 remains in good contact with the sleeve 20 and ensures perfect centering of the sleeve 20 on the body 1.

At its upper end the sleeve 20 bears via another O-ring 8 on the upper end of the body 1, although another assembly like the rings 3 and 4 could be provided here also.

In the factory the spout 2, cartridge 6, and handle 60 are mounted on the body 1. The chamfer 203 compresses the rings 3 and 4 inward as the sleeve 20 is slipped down over the body 1. In the field the faucet is installed by first securing the body 1 via the nut assembly 13 to the counter 1 and then connecting the feed lines 11 to it. The hose 4 is then fed down through the spout 2 and connected to the fitting 50.

I claim:

1. A faucet comprising:

a support body centered on an upright axis and adapted to be fixed to a horizontal support surface, the body being formed with a radially outwardly open outer groove having upper and lower axially spaced and confronting flanks and a radially outwardly directed floor;

a sleeve fitted over and surrounding the body and having a radially inwardly directed inner surface level with the outer groove and an axially downwardly directed shoulder generally level with the upper flank;

a hard split bearing ring set in the outer groove and having an outer face bearing on the inner sleeve surface, an upper face on which the shoulder rests, a lower face bearing on the lower flank, and an inner face radially confronting the floor; and means including a biasing element braced radially between the bearing ring and the body for pressing the outer face of the bearing ring against the inner surface of the sleeve.

2. The faucet defined in claim 1 wherein the biasing element is an unsplit elastomeric biasing ring bearing radially inward on the body and radially outward on the bearing ring.

3. The faucet defined in claim 2 wherein the body is formed in the outer-groove floor with a radially outwardly open inner groove.

4. The faucet defined in claim 1 wherein the bearing ring has a radial dimension greater than a radial depth of the outer groove, whereby the bearing ring projects radially past the groove floor and holds the inner ring face off the groove floor.

5. The faucet defined in claim 4 wherein the biasing element holds the bearing ring at least 0.2 mm radially outward from the groove floor.

6. The faucet defined in claim 1 wherein the bearing-ring end faces are parallel and perpendicular to the bearing-ring inner face.

7. The faucet defined in claim 6 wherein the bearing-ring outer face is outwardly convex.

8. The faucet defined in claim 1 wherein the bearing ring has a width measured parallel to the axis and a thickness measured perpendicular to the axis, the width being about three times the thickness.

9. The faucet defined in claim 1 wherein the inner surface of the sleeve is substantially cylindrical and centered on the axis.

10. The faucet defined in claim 9 wherein the sleeve has an outwardly chamfered lower end edge.

11. The faucet defined in claim 1, further comprising a valve cartridge carried on the body and connectable through the body with hot- and cold-water supplies, the sleeve being surrounding the cartridge and being formed with a spout;

a spray head fittable in the spout, and a hose connected to the valve cartridge and extending to the spray head.

12. The faucet defined in claim 11 wherein the hose extends from the cartridge down through the body and then back up through the body to the spray head.

* * * * *